US005461743A

United States Patent [19]

Stubler et al.

[11] Patent Number: 5,461,743

[45] Date of Patent: Oct. 31, 1995

[54] METHODS AND APPARATUSES FOR MOUNTING MULTIPLE-STRAND STAYS OF BRIDGES

[75] Inventors: Jérôme Stubler, Paris; Raymond Chastagnoi, Epernon, both of France

[73] Assignee: Freyssinet International et Cie, Velizy, France

[21] Appl. No.: 214,255

[22] Filed: Mar. 17, 1994

[30] Foreign Application Priority Data

Mar. 18, 1993 [FR] France ..... 93 03146

[51] Int. Cl.[6] ..... E01D 11/00

[52] U.S. Cl. ..... 14/22

[58] Field of Search ..... 14/18–22

[56] References Cited

U.S. PATENT DOCUMENTS

| | | | |
|---|---|---|---|
| 5,060,332 | 10/1991 | Webster | 14/21 |
| 5,121,518 | 6/1992 | Muller | 14/22 X |
| 5,208,932 | 5/1993 | Muller | 14/21 |
| 5,241,721 | 9/1993 | Muller | 14/22 |

FOREIGN PATENT DOCUMENTS 2673959 9/1992 France .

OTHER PUBLICATIONS

Beton und Stahlbetonbau, vol. 83, No. 12, Dec. 1988, Berlin, DE, Hochleistungsfahige Schragseile Aus Der Sicht Des Betonbauers'.

Travaus, No. 666, Jun. 1991, Paris, France Montens et al, Le Franchissement De L'Isere Par L'Autoroute A49', pp. 16–40.

*Primary Examiner*—Michael Powell Buiz
*Attorney, Agent, or Firm*—Larson & Taylor

[57] ABSTRACT

To mount a multiple strand stay of a stayed bridge between a tower and a deck of said bridge, one of the strands ($4_1$) that is to make up the stay is installed in its final oblique position; a guide cage is suspended from said strand installed in this way, the cage being constituted by a sequence of rigid hoops (5) that are interconnected by strings (6), said cage surrounding said first strand and also surrounding a traction cable (9); said cable is used to pull successive strands (4) up inside the cage; after each strand has been pulled up, it is put under tension so that it bears laterally against the already installed strands, and its ends are anchored respectively to the tower and to the deck; and after all of the strands have been installed, the guide cage is removed from the completed stay.

10 Claims, 2 Drawing Sheets

METHODS AND APPARATUSES FOR MOUNTING MULTIPLE-STRAND STAYS OF BRIDGES

BACKGROUND OF THE INVENTION

The invention relates to stays for fitting to stayed bridges where they connect the towers of such bridges to their decks, which stays are constituted by multiple strands juxtaposed side by side, with each of the strands itself preferably being of the "individually protected" type, i.e. constituted by a bundle of metal wires that are parallel or twisted together and that are received in a continuous sheath together with an interposed protective substance.

More particularly, the invention relates to methods and apparatuses for mounting stays of the kind in question in their final oblique configurations in which the stays together make up sheets, generally vertical sheets, disposed on either side of each tower.

More particularly, the invention relates to the case where at least some of the stays to be mounted are very long, which length may exceed 200 meters.

Under such circumstances, it is hardly possible to implement the known technique of making up a complete stay horizontally at the foot of the tower which is to support it, and then raising the end of said stay that is located adjacent to the tower by pulling on the stay, given that the weight of the stay is too great.

Another known technique for mounting stays of the kind in question consists in using a cableway type system to pull said stay obliquely along its axis after the stay has already been made up, i.e. after its component strands have been juxtaposed side by side.

For this purpose, a carrier cable is initially suspended between a high point of the support tower and the deck, and a fastening member having the head or top end of the stay coupled thereto is caused to run along said cable by means of suitable running gear.

Prior installation of such a carrier cable is itself an operation that is difficult and expensive, and in this case also, the forces brought into play when pulling on the stay become prohibitive for very great lengths.

The invention seeks, above all, to remedy those various difficulties.

SUMMARY OF THE INVENTION

To this end, according to the invention, the methods of mounting stays of the kind in question are essentially characterized in that the stay is built up directly, strand by strand, in its final oblique position by performing the following sequence of operations:

one of the strands for making up the stay is installed in its final oblique position, this stage of installation being terminated by putting the strand under tension and anchoring its ends respectively to the tower and to the deck;

a guide cage for the following strands is suspended from said first strand installed in this way, the cage extending over the entire length of said strand and being made up of a sequence of rigid hoops interconnected by strings, said cage surrounding said first strand and also surrounding a traction cable;

the subsequent strands making up the stay are pulled up (optionally in pairs) successively inside the cage by means of said cable;

after each strand has been pulled up, it is put under tension so that it bears laterally against the already-installed strand or set of strands, and its ends are anchored respectively to the tower and to the deck; and after all of the strands have been installed, the guide cage is removed from the completed stay.

In preferred implementations, use is also made of one or more of the following dispositions:

to construct the various oblique stays constituting a common sheet that is vertical or substantially vertical, the following operations are performed: initially the shortest bottom stay is mounted, after which each of the other stays is mounted going progressively upwards from stay to stay and, when mounting the first strand of each of the stays other than the bottom stay, use is made of the guide cage that has served for mounting the preceding stay, while said cage is still suspended from the preceding stay;

if two vertical or substantially vertical sheets of oblique stays are provided on the same longitudinal side of a tower with the two sheets forming an acute dihedral angle, two stays are mounted simultaneously, one each of the two sheets, the stays being located at the same level and a single traction cable being used that extends around a closed circuit in the form of an isosceles triangle defined by pulleys, the two equal long sides of said triangle extending along the oblique axes of the two stays to be mounted, and the third side extending horizontally, across-the bridge, and including a reversibly rotatable winch or the like.

Apparatuses for mounting stays of the kind in question are essentially characterized in that they comprise a guide cage for the strands and the traction cable, the cage being made up of a succession of rigid hoops interconnected by strings, each hoop comprising an arc and an easily removable bottom closure bar.

In preferred embodiments, such mounting apparatuses further include the application of one or more of the following dispositions:

the guide cage comprises three parallel strings, one being attached to the tops of the various arcs, and the other two strings being attached to the feet of said arcs;

the guide cage contains at least one wire parallel to the strings and serving as a guide rail for a sliding carriage, said carriage being fixed at an intermediate point of the traction cable and being disposed in such a manner that the heads of the strands to be installed are easily attachable thereto in removable manner;

the carriage according to the preceding paragraph has two rigid tubular lengths on either side thereof, the lengths having two respective guide wires passing therethrough, which wires are contained inside the cage;

in the vicinity of each arc foot, each hoop comprises two internal tongues co-operating with the adjacent portions of the arc and of the bar to form an eye having a narrow opening in which a respective one of two guide wires as defined in the preceding paragraph are received;

the above or "main" carriage is associated with an auxiliary carriage which is fixed in easily removable manner to an intermediate point of the traction cable disposed a little higher than the main carriage, which auxiliary carriage is also mounted to slide on each of the guide wires and is organized in such a manner that the heads of the strands to be installed are easily fastenable thereto in removable manner.

each carriage is organized in such a manner that the heads of two strands to be installed are easily fastenable thereto in removable manner; and the distance between successive hoops of the cage lies in the range 5 meters to 10 meters.

In addition to the above main dispositions, the invention also comprises various other dispositions that are preferably used simultaneously therewith and that are explained below.

BRIEF DESCRIPTION OF THE DRAWINGS

Various preferred implementations of the invention are described below, naturally in non-limiting manner, and with reference to the accompanying drawings, in which.

DETAILED DESCRIPTION OF THE INVENTION

Figure 1:
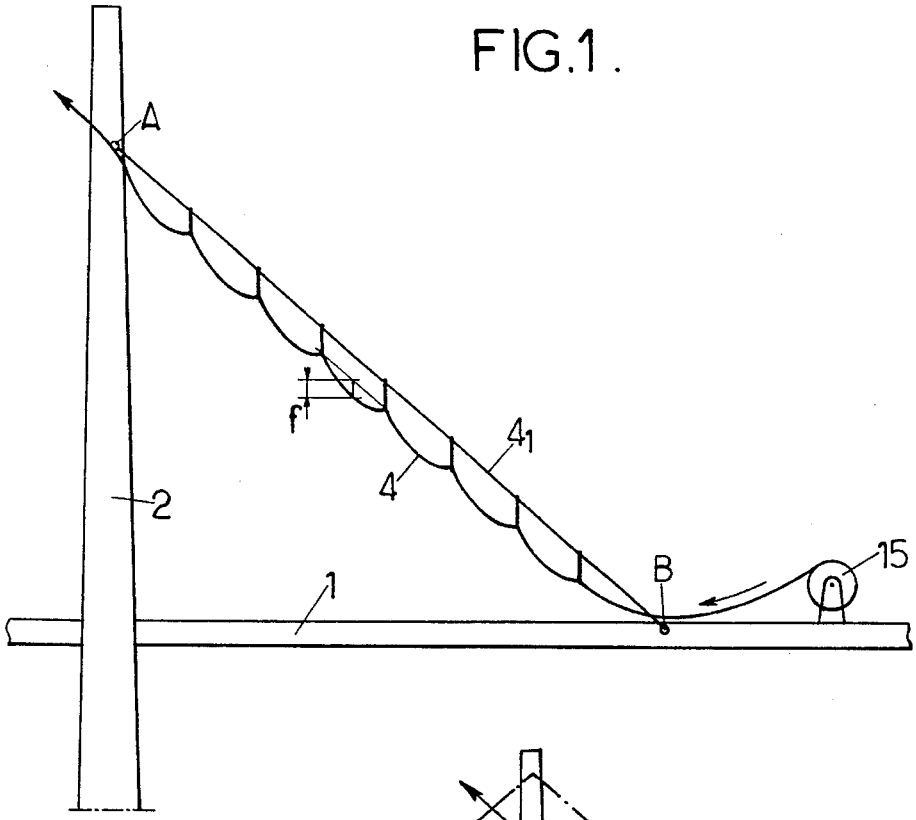
FIG. 1 is highly diagrammatic and shows the general technique of the invention for mounting a stay.

The objective is to support a deck 1 of a bridge by means of at least one tower or pillar 2 using a plurality of stays 3 (FIG. 5) extending in oblique directions that are substantially mutually parallel between the deck and the tower so as to form sheets that are vertical or substantially vertical.

Each of the stays 5 is constituted by a plurality of independent strands, i.e. strands that can be mounted and put under tension independently from one another, and that can even be replaced in isolation, under certain circumstances.

Each strand 3 may be constituted by a single heavy wire, however it is preferably made up of a central core surrounded by a plurality of touching wires, generally six touching wires, wound helically around said core, with each of the wires and the core advantageously having surface protection, e.g. by galvanization, and with the entire resulting twisted assembly itself being surrounded by a waterproof protective sheath, generally made of plastics material, and optionally with a suitable protective binder such as a petroleum wax being interposed.

The running portions of "individually protected" or "self-protected" strands as defined above are juxtaposed laterally, and they are clamped against one another by collars (not shown).

For large bridges, each stay 3 is made up of several tens of strands 4.

If the length of multiple strand stays made up in this way is great, in particular if it exceeds 200 meters, or 300 meters, or even 400 meters, then the resulting weight of each stay is enormous and there are serious problems involved in mounting such stays on towers.

In the present invention, a stay is mounted as follows.

For each stay, one of the strands ($4_1$) making up the stay is installed by anchoring the head of the strand at a first point A on the support tower 2, and the foot of the strand at a second point B on the deck 1.

Such installation is advantageously performed in the manner explained below with reference to FIG. 5.

However, it may be performed in any other desirable manner, e.g. by implementing the first method recalled above (vertically raising the head of a strand that extends horizontally from the foot of the tower), it being understood that the weight of a single strand is relatively small.

Thereafter, this first strand $4_1$ installed as described above is used as a support for the equipment that serves to mount the following strands, which strands in turn serve to reinforce the first strand in its supporting function as soon as they have themselves been installed.

To mount each "following" strand 4, i.e. each strand after the first, the procedure is as follows.

A lightweight guiding cage in the form of a sequence of rigid stirrup-shaped hoops 5 interconnected by light cables or "strings" 6 (FIGS. 2, 3, and 4) is installed on the first strand $4_1$.

Each hoop 5 comprises an arc 7 whose base is closed by an easily-removable horizontal bar 8.

There are preferably three such strings 6, attached to each arc 7 respectively at the top C thereof and at the two feet D and E thereof.

The top string 6 attached to the top C of the arcs rests directly on the strand $4_1$ and tension is applied to the string in such a manner as to ensure that each hoop is stabilized with its bar 8 disposed horizontally and beneath the top of the hoop.

The distance between successive hoops 5 generally lies in the range 5 meters to 10 meters, such that each "cage" comprises several tens of hoops.

The cage serves to contain firstly a traction cable 9 and secondly at least one, and preferably two wires 10 and 11 suitable for serving as guide rails for at least one carriage 12.

In the vicinity of each end of the bar 8 constituting its base, each hoop 5 has two inside tongues 13 and 14 that co-operate with the adjacent portions of the hoop to form two eyes, each having a narrow opening.

Each of these eyes has a corresponding one of the wires 10, 11 passing therethrough.

The sides of the carriage 12 are defined by two tubular rings 15 each threaded on a corresponding one of the wires 10 and 11, and the dispositions and dimensions of these rings and of the above-described eyes are such as to enable the rings to pass easily through the eyes: the respective bearing surfaces of the rings and of the eyes that are suitable for coming axially into contact are all formed with appropriate slopes (not shown) to make it possible to insert the rings easily into the eyes.

The carriage 12 is fixed to an intermediate point of the traction cable 9, and the head of at least one strand 4 is fastened to said carriage in a manner that is easily unfastened, using appropriate means, e.g. by clamping the strand between the chassis of said carriage 12 and a jaw 19 screwed down onto the chassis.

Figure 2:
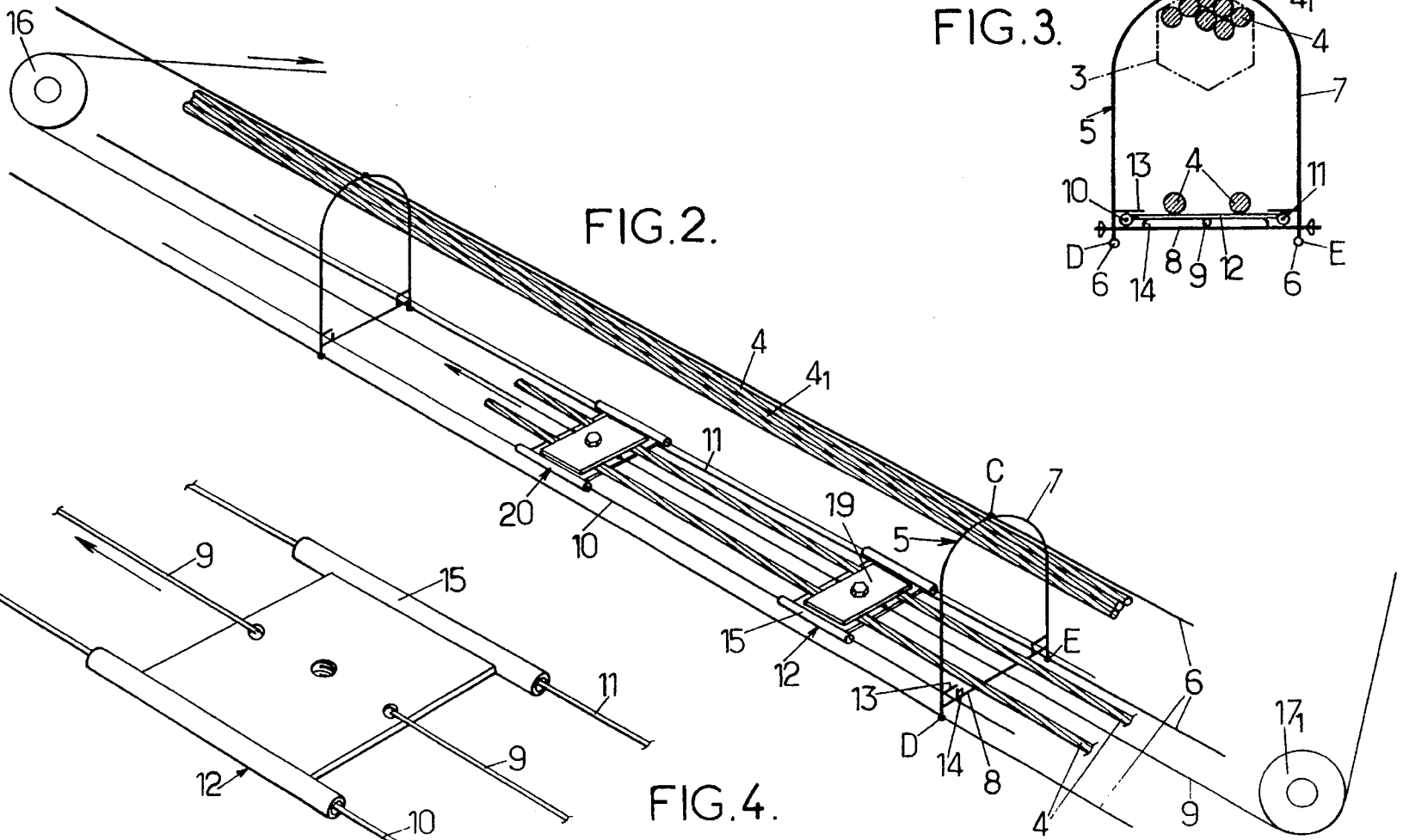
FIG. 2 is a diagrammatic perspective view on a larger scale showing a portion of the corresponding apparatus for mounting a stay.

As can be seen in FIG. 2, one end of each strand 4, i.e. the end constituting the head of the strand, projects upwards beyond the carriage 12.

In a preferred embodiment, a second carriage 20 or "auxiliary" carriage, is disposed close to the top end of each of the strands in question, which auxiliary carriage has the following characteristics:

it is fastened in an easily removable manner by means (not shown) to an intermediate point on the traction cable 9 disposed higher than the carriage 12;

it is slidably mounted in an easily removable manner on the rails 10 and 11 via means that are not shown; and each head of a strand 4 is secured thereto in a manner that is easily removable, as for the carriage 12.

The apparatus described above operates as follows.

After the first strand $4_1$ has been installed, and after the cage 5–6 has been installed on the strand, together with the cable 9 and the wires 10 and 11 inside said cage, the carriages 12 and 20 are placed initially inside the bottom of the cage (i.e. close to the point B of FIG. 1) and they are secured to said cable 9, with the carriage 10 being one or two meters away from the carriage 12 towards the tower 2.

The head of at least one strand 4 is then secured to the carriages (in the embodiment shown, the number of strands 4 is two), or more precisely one end of at least one continuous cable suitable for forming the desired strand after being paid out and cut to length as paid out, in particular from a horizontal axis drum 15.

Thereafter the carriages are pulled upwards in the direction of arrow F by means of the traction cable 9.

The rings 15 of the carriages then pass through the above-defined eyes of the hoops 5 and the pulled strands 4 pass through said hoops 5 in succession, sliding along their bottom bars 8.

While this is taking place, the various lengths of strand 4 extending between consecutive pairs of bars 8 sag down a little under the effect of gravity, however the vertical extent f of such sagging (FIG. 1) in each of said lengths is relatively small, thereby ensuring that the traction force to be exerted on the cable 9 is also relatively small.

When the head of each strand 4 as pulled in this way reaches the high point A, said head is disconnected from the upper carriage 20, the carriage 20 is detached both from the traction cable 9 and from the guide rails 10 and 11, and the stripped end of the head in question is threaded into its anchor device which is generally constituted by a split wedge-shaped grip received in a complementary bore of an anchor block.

Thereafter, the traction cable 9 is used to continue upwards displacement of the carriage 12 so that the head of the strand 4 is inserted further into its anchoring grip.

Once a sufficient length has been inserted to enable a conventional traction actuator to take over, the head is released from the carriage 12, the bottom of the corresponding strand is cut close to the low point B, and both ends of the strand are anchored in any known desirable manner respectively in the vicinity of the anchor zones for the top and bottom ends of the first strand $4_1$.

This anchoring has the effect of laterally juxtaposing each new strand 4 against the previously installed and tensioned strand $4_1$, which is made possible by the fact that all of the strands, including the first, are disposed inside the cage formed by the sequence of hoops 5.

Figure 3:
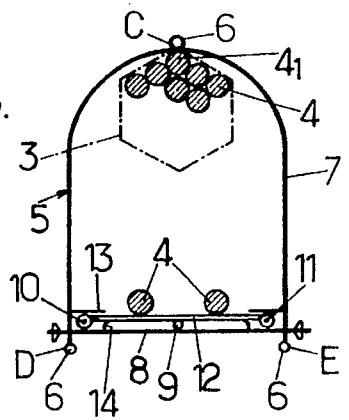
FIG. 3 is a cross-section on an even larger scale through the same apparatus.
Figure 4:
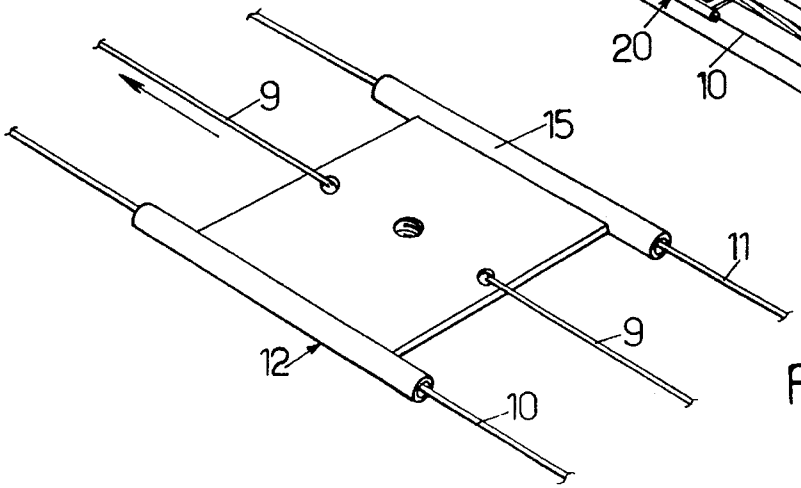
FIG. 4 is on a still larger scale and is a perspective view of a component of the apparatus.

It is thus the bundle of strands that have already been juxtaposed in this manner which supports the cage and its accessories (see the strands grouped together in the top portion of the cage in FIGS. 2 and 3).

Thereafter, the cable 9 is used to cause the carriage 12 to move back down empty to the bottom of the cage, together with the carriage 20 after it has been mounted back on the rails and reattached to said cable.

The carriages are then coupled again to the head of at least one new strand, and it is installed in the same manner as the preceding strands, and so on until the last strand has been installed: the stay is then complete.

It is then possible to recover the cage by sliding it down along the completed stay, and then opening the bottom of each hoop by at least partially releasing the bar 8 thereof.

Figure 5:
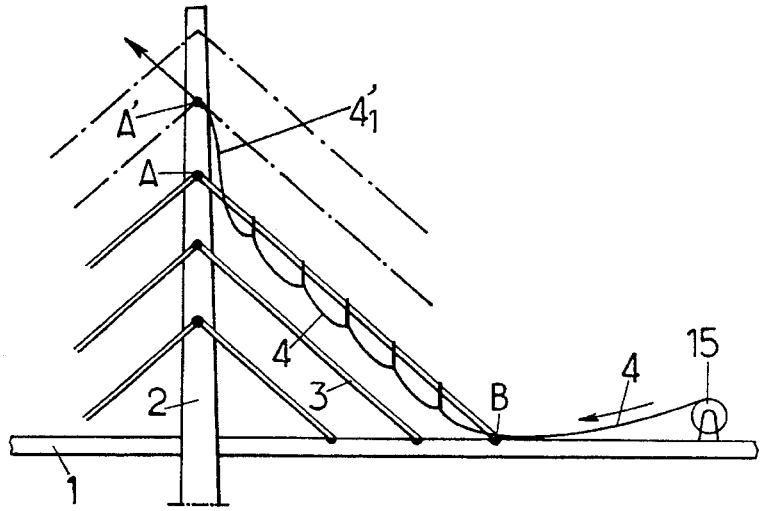
FIG. 5 is a highly diagrammatic view of a particular stage while mounting stays, likewise in accordance with the invention.

In an advantageous improvement shown diagrammatically in FIG. 5, and applicable to installing each "first strand" $4'_1$ constituting a "new stay" situated immediately above a stay that has just been terminated, i.e. a "preceding stay", use is made of the cage that still surrounds the preceding stay, immediately after it has been completed, for the purpose of installing said new "first strand".

In other words, the carriage 12 is used again as before for raising the first strand $4'_1$ up to the vicinity of the point A belonging to the "preceding stay", but instead of anchoring the head of this strand at the level of said point A, it is anchored at the next higher level at point A', where the new stay is to be anchored.

To this end, said head of the strand $4'_1$ needs merely to be lifted through the height A, A'.

This lifting operation does not present a major problem since the height A,A' is small and the weight of a single strand is relatively small.

Naturally, the first strand of the new stay may alternatively be raised after the cage has been disengaged from the preceding stay.

As mentioned above, it is possible to disengage the cage from a completed stay because its bars 8 are easily removable: once the bars have been moved aside or separated from the corresponding arcs 7, the arcs are downwardly open and can therefore be disengaged from the stay on which they are astride merely by being lifted.

It is then very easy subsequently to place them on the first strand $4'_1$ of the next stay to be made up merely by placing the hoops 7 astride the first strand and closing the corresponding bars 8 beneath said strand so as to form the hoops 5 constituted by said arcs and said bars.

The method described above for installing each "first strand" of a stay that is installed above a "preceding stay" is naturally unsuitable for use in installing the lowest stay of each sheet.

However, that is not a severe drawback since said lowest stay is generally relatively short and the height of its head is relatively low: the corresponding first strand is thus relatively light and there is no major difficulty in mounting it.

Figure 6:
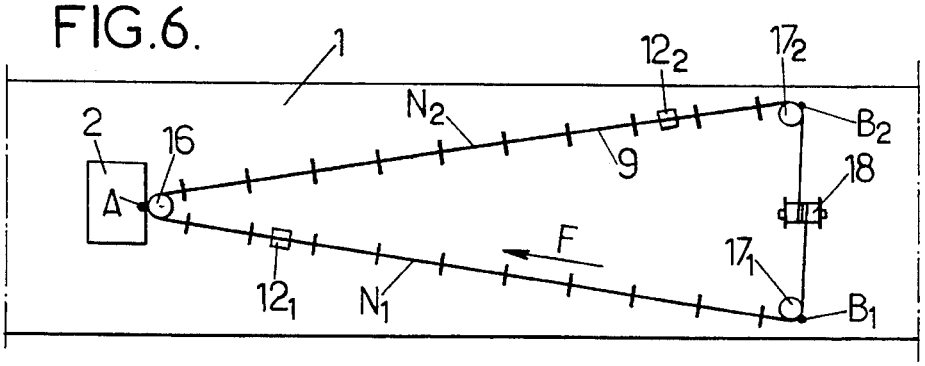
FIG. 6 is a diagrammatic plan view of a portion of a stayed bridge under construction and showing apparatus of the invention for mounting a stay.

FIG. 6 shows another improvement applicable to a stayed bridge in which the oblique stays connecting the deck 1 to one of the faces of a tower 2 do not constitute a single longitudinal vertical sheet or two such sheets in parallel, but lie in two vertical or substantially vertical sheets $N_1$ or $N_2$ that diverge away from the tower and that together form, at least approximately, a dihedral angle that is relatively small about a vertical axis.

Under such circumstances, it is advantageous to build up stays at the same level in the two sheets simultaneously, and the method described above lends itself very well to building up stays simultaneously.

To this end, the traction cable 9 is caused to follow a closed circuit in the form of an isosceles triangle $AB_1B_2$ having two equal long sides $AB_1$ and $AB_2$ that extend respectively along the axes of the two stays to be built up, and a short side $B_1B_2$ that is horizontal, at the bottom, and perpendicular to the long dimension of the bridge, which short side is located at the same level as the deck, and extends across the deck.

The angles $A,B_1$ and $B_2$ are physically embodied by respective pulleys 16, $\mathbf{17}_1$ and $\mathbf{17}_2$.

An intermediate length of cable 9 is wound on a control winch 18 mounted on the deck 1 and capable of working alteratively in both directions.

Under such circumstances, the strands constituting the two stays to be made up extend respectively along the two sides $AB_1$ and $AB_2$, and respective lightweight cages comprising hoops and strings of the kind defined above are disposed along said sides.

The two corresponding carriages (or "double carriages") are respectively referenced $\mathbf{12}_1$ and $\mathbf{12}_2$ in FIG. 6.

It can be seen that for one direction of rotation of the winch 18 corresponding to arrow F, the carriages $\mathbf{12}_1$ move up from point $B_1$ to point A, while simultaneously the carriages $\mathbf{12}_2$ move down along side $AB_2$.

The opposite takes place when the winch 18 is rotated in the other direction.

The strands constituting the two stays to be made up can thus be hoisted turn and turn about merely by reversing the direction of rotation of the winch 18.

As a result, and whatever implementation is used, the final result is to obtain apparatuses for mounting multiple strand stays, with the structure, implementation and advantages of such apparatuses being sufficiently clear from the above description.

Naturally, and as also stems from the above, the invention is not limited to the particular applications and implementations that have been described; on the contrary, the invention extends to any variants thereof.

We claim:

1. A method of mounting a multiple strand stay of a stayed bridge between a tower and the deck of said bridge, the method being characterized in that the stay is built up directly, strand by strand, in its final oblique position by performing the following sequence of steps: installing one of the strands for making up the stay in its final oblique position, this stage of installation being terminated by putting the strand under tension and anchoring its ends respectively to the tower and to the deck; suspending a guide cage for the following strands from said first strand installed in this way, the cage extending over the entire length of said strand and being made up of a sequence of rigid hoops interconnected by strings, said cage surrounding said first strand and also surrounding a traction cable; pulling up the subsequent strands making up the stay successively inside the cage by means of said cable; after each strand has been pulled up, putting each strand under tension so that it bears laterally against the already-installed strand or set of strands, and its ends are anchored respectively to the tower and the deck; and after all of the strands have been installed, removing the guide cage from the completed stay.

2. A method according to claim 1, for mounting the various oblique multiple-strand stays constituting a common vertical or substantially vertical sheet of a stayed bridge, the method further comprising the following steps: initially mounting the shortest bottom stay, after this mounting, mounting each of the other stays going progressively upwards from stay to stay and, when mounting the first strand of each of the stays other than the bottom stay, using the guide cage that has served for mounting the preceding stay, while said cage is still suspended from the preceding stay.

3. A method according to claim 1, for mounting two vertical or substantially vertical sheets of oblique stays on the same longitudinal side of a tower of a stayed bridge, the two sheets together forming an acute dihedral angle, the method comprising mounting two stays simultaneously, one for each of the two sheets, the stays being located at the same level and said method further comprising using a single traction cable that extends around a closed circuit in the form of an isosceles triangle defined by pulleys, the two equal long sides of said triangle extending along the oblique axes of the two stays to be mounted, and the third side extending horizontally, across to the bridge, and including a reversibly rotatable winch or the like.

4. A mounting apparatus for mounting a multiple strand stay of a stayed bridge between a tower and the deck of said bridge, wherein the stay is built up directly, strand by strand, in its final oblique position and wherein one of the strands for making up the stay is installed in its final oblique position, said apparatus comprising means for installing one of the strands making up the strands in its final oblique position, by putting said one strand under tension and anchoring its ends respectively to the tower and to the deck, thereby terminating this stage of the installation; a guide cage for the following strands suspended from the one strand, said cage being removable from the completed stay after all of the strands are installed and said guide cage extending over the entire length of said strand and comprising a sequence of rigid hoops interconnected by strings, each of said hoops comprising an arc and an easily removable closure bar, said cage surrounding said first strand and also surrounding a traction cable for pulling up the subsequent strands making up the stay successively inside the cage, each strand, after it has been pulled up, being put under tension so that the pulled up strand bears laterally against the already-installed strand or set of strands, and its ends are anchored respectively to the tower and to the deck.

5. Mounting apparatus according to claim 4, wherein the arcs of the hoops include feet and wherein the guide cage comprises three parallel strings, one string being attached to the tops of the arcs of the hoops, and the other two strings being attached to the feet of said arcs.

6. Mounting apparatus according to claim 4, wherein the guide cage contains at least one wire parallel to the strings and serving as a guide rail for a sliding carriage, said carriage being fixed at an intermediate point of the traction cable and being disposed in such a manner that the heads of the strands to be installed are easily attachable thereto in removable manner.

7. Mounting apparatus according to claim 6, wherein the carriage has two rigid tubular lengths on either side thereof, the lengths having two respective guide wires passing therethrough, which wires are contained inside the cage.

8. Mounting apparatus according to claim 6, wherein said sliding carriage comprises a main carriage and is associated with an auxiliary carriage which is fixed in an easily removable manner to an intermediate point of the traction cable disposed a little higher than the main carriage, said auxiliary carriage also being mounted to slide on each of the guide wires and being organized in such a manner that the heads of the strands to be installed are easily fastenable thereto in a removable manner.

9. Mounting apparatus according to claim 6, wherein said each carriage is organized in such a manner that the heads of two strands to be installed are easily fastenable thereto in removable manner.

10. Mounting apparatus according to claim 4, wherein the distance between successive hoops of the cage lies in the range 5 meters to 10 meters.

* * * * *